United States Patent [19]

Asada

[11] Patent Number: 4,927,204

[45] Date of Patent: May 22, 1990

[54] DOOR OPENING/CLOSING DEVICE

[75] Inventor: Tohru Asada, Kariya, Japan

[73] Assignee: Aisin Seiki Kabushiki Kaisha, Kariya, Japan

[21] Appl. No.: 211,501

[22] Filed: Jun. 24, 1988

[30] Foreign Application Priority Data

Jun. 27, 1987 [JP] Japan ..... 62-160215

[51] Int. Cl.[5] ..... E05C 3/26

[52] U.S. Cl. ..... 292/216

[58] Field of Search ..... 292/216, 201, 280, 336.3, 292/122, 220

[56] References Cited

U.S. PATENT DOCUMENTS 4,183,177 1/1980 Kurdziel ..... 49/25
4,688,036 8/1987 Hirano et al. ..... 70/257 X
4,763,936 8/1988 Rogakos et al. ..... 292/201
4,815,775 3/1989 Mertin et al. ..... 292/201

*Primary Examiner*—Richard E. Moore
*Attorney, Agent, or Firm*—Finnegan, Henderson, Farabow, Garrett and Dunner

[57] ABSTRACT

In the present invention, while a door is being closed, a latching member in engagement with a striker. In case that this engagement is insufficient, a motor operated member brings the latching member into assure engagement with the striker. During this operation, a pawl is also engaged with the latching member. Once the pawl is engaged with the latching member, resulting engagement may not be released except for the urging from the motor operated member to the pawl. Thus, the latching operation and the locking operation may be performed by a common motor.

6 Claims, 9 Drawing Sheets

DOOR OPENING/CLOSING DEVICE

BACKGROUND OF THE INVENTION

1. Field of the Invention

The present invention relates to a door opening/closing device and in particular to a door latching/unlatching device in which both the latching and the locking are operated electrically.

2. Description of the Prior Art

A conventional door opening/closing device of this type is disclosed in U.S. Pat. No. 4,183,177, for example. The disclosed device has a first mechanism for latching which is operatively connected to a first solenoid via a first link mechanism and a second mechanism for locking which is operatively connected to a second solenoid via a second link mechanism. For opening a door in this device, after the second mechanism is brought into an unlocked condition by energizing the second solenoid, the first solenoid is energized.

However, since each mechanism has to include the solenoid and the link mechanism therebetween, the conventional device is complex in construction. Further, the latching and the locking operations may not be performed in the conventional device.

SUMMARY OF THE INVENTION

It is, therefore, a principal object of the present invention to provide a door opening closing device without afore-mentioned drawbacks.

It is another object of the present invention to provide a door opening/closing device in which both of the latching and the locking operations are performed by a common electrical means.

It is further object of the present invention to provide a door opening/closing device by which the latching and the locking operations may be performed.

According to the present invention, a door opening/-closing device comprises a striker; a latching member rotatably mounted to a door so as to be movable between a first position and a second position for engaging with and disengaging from the striker, respectively; a pawl rotatably mounted to the door so as to be movable between a regulating position and a releasing position for holding the latching member at its first position and permitting the movement of the latching member to its second position, respectively; an urging means for holding the pawl at its regulating position; and a controlling means including a motor and an operating member driven by the motor so as to bring the latching member into its first position while the door is being closed and disengaging the pawl from the latching member before the door is opened.

In the present invention, since the latching member is engaged with the striker due to actuation of the motor and upon completion of this engagement, the pawl is brought into engagement with the latching member. Thus, the latching and the locking operations are performed automatically by the actuation of the common motor.

BRIEF DESCRIPTION OF THE DRAWINGS

FIG. 2*e* is a diagram of a control device of the device shown in FIG. 1*a.

DETAILED DESCRIPTION OF THE PREFERRED EMBODIMENT

Figure 2A:
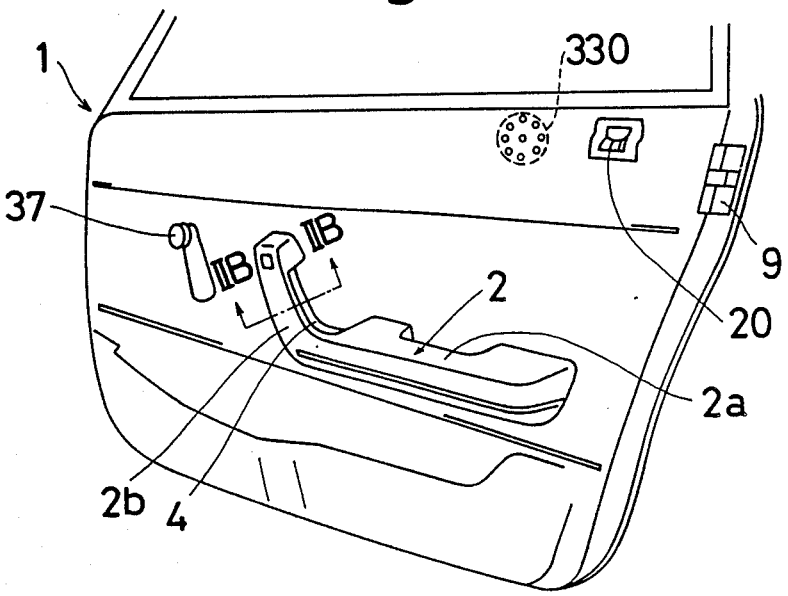
FIG. 2*a* is an inside view of the door.
Figure 2B:
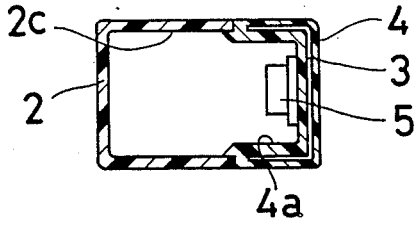
FIG. 2*b* is a cross-sectional view of a holding portion.

Referring first to FIGS. 2*a* and 2*b*, a door 1 is provided at an inside thereof with a grip 2 having a main portion 2*a* and a holding portion 2*b*. Between the holding portion 2*b* and the inside of the door 1, there is defined a space so that the holding portion 2*b* may be gripped by a hand of a motorist or a driver upon the opening or the closing the door 1. The grip 2 is made of an insulator such as synthetic resin, and has a cutout portion 2*c* which is open towards the inside of the door 1. The cutout portion 2*c* is fitted therein with a lid 4*a* having insulating properties. The lid 4*a* is provided at an outer surface and an inner surface thereof with an outer cover 4 and a pulse generator 5, respectively. The pulse generator 5 is in electrical connection with a thin metal plate 3 which is disposed between the lid 4*a* and the cover 4. Since the space is defined between the grip 2 and the inside of the door 1, the thin metal plate 3 and the door 1 constitute therebetween a condensor having a capacitance Ch. The capasitanse Ch is increased in case that the hand of the motorist is positioned between the holding portion 2*b* and the inside of the door 1 when he grips the holding portion 2*b* of the grip 2. Thus, the condensor acts as a conventional inside door handle.

Figure 2C:
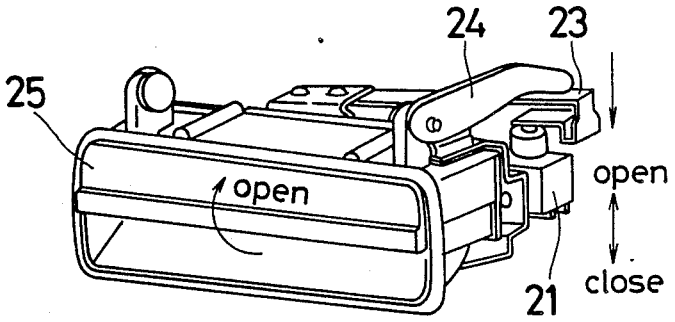
FIG. 2*c* is an outside view of an out door handle.
Figure 2D:
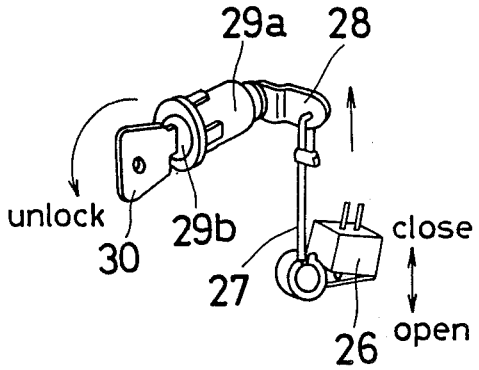
FIG. 2*d* is a view of a key cylinder into which a key is inserted.

At the inside of the door 1, as shown in FIG. 2*a*, there is provided a locking switch 20 corresponding to the conventional locking knob, a buzzer 330 and a handle 37 for moving a glass in the vertical direction. At the outside of the door 1, there is provided an outer door handle 25 which is shown in FIG. 2*c*, and a door key cylinder 29*a* which is shown in FIG. 2*d*.

Referring to FIGS. 1*a* through 1*d*, there is shown detailed construction of an opening/closing device 9 to be provided in the door 1. As apparent from the description, which is detailed hereinafter, in the device 9, the latching/unlatching function and the locking/unlocking function are performed by a common means, thereby eliminating complexity in construction.

Figure 1A:
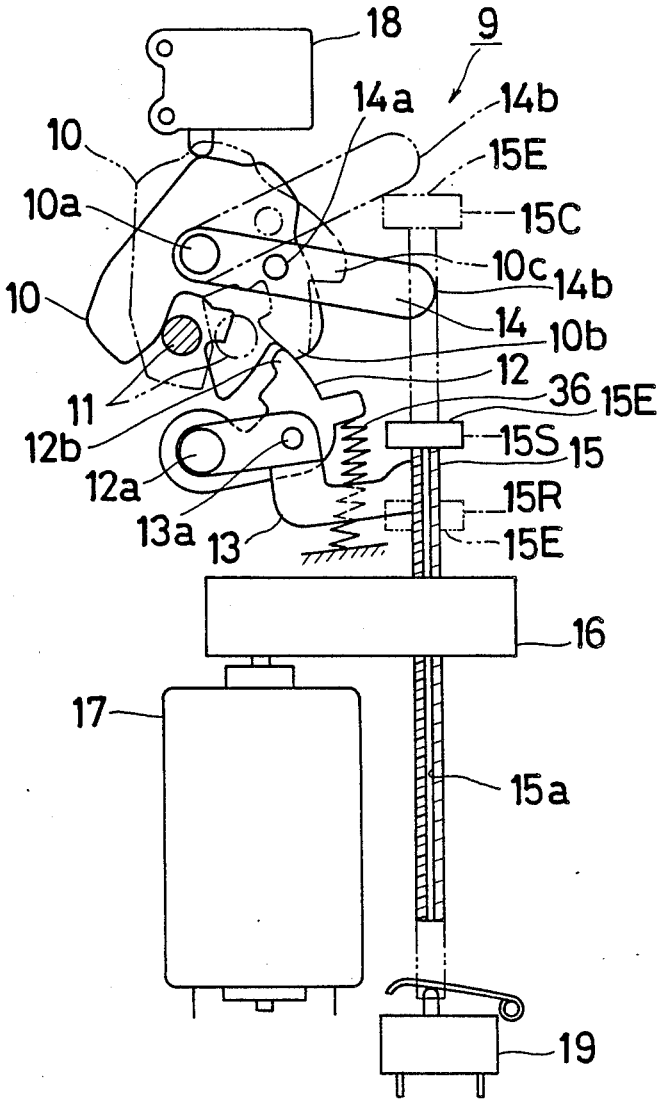
FIG. 1*a* is a view showing a construction of a door opening/closing device according to the present invention.

A latching member 10 is rotatably mounted on a pin 10*a* which is fixed to a frame (not shown) of the door 1. On the pin 10*a*, there is also rotatably mounted a locking lever 14. The latching member 10 and the latching lever 14 are connected with each other by a pin 14*a*. As is well known, the latching member 10 includes an opening for receiving a striker 11, defined by a first projection 10*b* and a second projection 10*c*. A pawl member 12 is rotatably mounted on a pin 12*a* fixedly connected to the door-frame, and has a projection 12b which is engageable with the first projection 10b or the second projection 10c of the latching member 10. The former engagement and the latter engagement are referred to as a full-latched condition and a half-latched condition, respectively. A pawl-lever 13 is rotataby mounted on the pin 12a and is fixedly connected to the pawl member 12. The pawl member 12 is continually urged in the counter-clockwise direction in engagement with the latching member 10. In FIG. 1a, while the door 1 is in the half-latched condition (full latched condition), the latching member 10 is shown in solid line (two-dotted line).

Between a distal end portion 14b of the locking lever 14 and a distal end portion 13b of the pawl-lever 13, there is positioned an engaging member 15E which is fixedly connected to a top end portion of a threaded shaft 15. The shaft 15 is held at a reducer 14 so as to be moved in the vertical direction. That is to say, a shaft (not shown) of a motor 17 is operatively connected to the shaft 15 and an axial groove 15a formed in the shaft 15. Since the groove 15a is in sliding engagement with a guide member (not shown) fixedly positioned in the reducer 14, the shaft 15 is moved in the upward (downward) direction when the shaft of the motor 17 is rotated in the normal (reverse) direction. Since the relationship between the motor 17 and the shaft 15 is well-known, the description thereof is omitted.

Figure 1B:
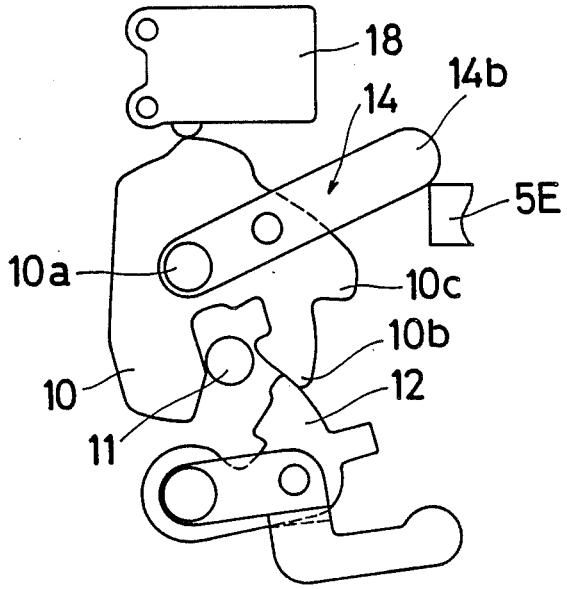
FIG. 1*b* is a view showing relationship between a latching member and a striker while a door is in the full-latched condition.
Figure 1C:
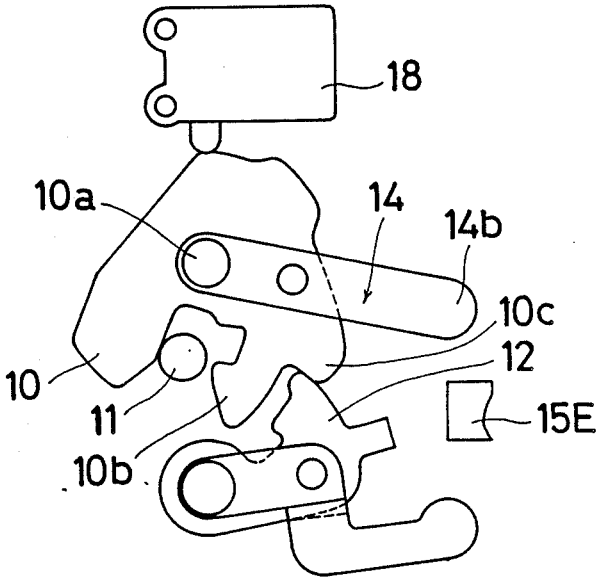
FIG. 1*c* is a view showing relationship between the latching member and the striker while the door is in the half-latched condision.
Figure 1D:
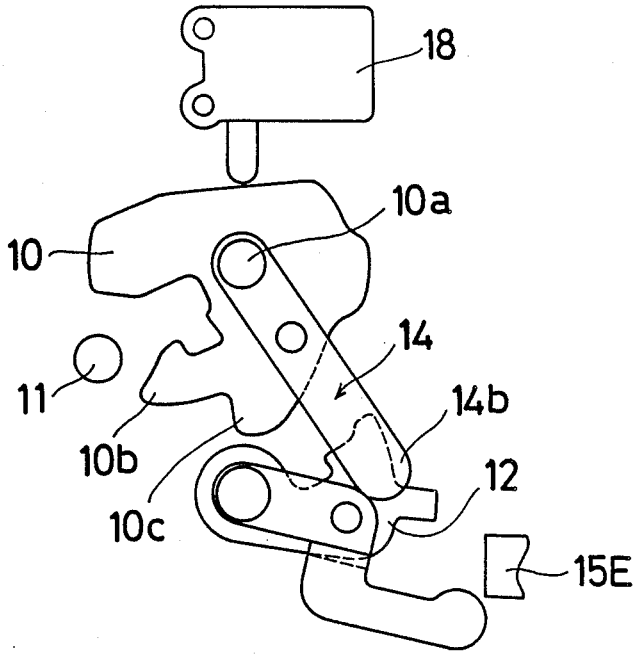
FIG. 1*d* is a view showing relationship between the latching member and the striker while the door is in the released condition.

While the member 15E is being moved from a third position 15S to a first position 15C, the member 15E is brought into engagement with the distal end portion 14b of the locking lever 14 with resulting that the locking member 10 is rotated in the counter-clockwise direction in FIG. 1a. In other words, the locking member 10 is transferred from a third condition as shown in FIG. 1c corresponding to the half-latched condition of the door 1 to a first condition as shown in FIG. 1b corresponding to the full-latched condition of the door 1. A switch 18 is in abutment with an outer periphery of the latching member 10 and is closed when the latching member 10 is in the second position (corresponding to the half-latched condition of the door 1) as shown in FIG. 1c or is in the first position (corresponding to the full-latched condition of the door 1) as shown in FIG. 1b. When the switch 18 is closed at the half-latched condition of the door 1, a signal "0" indicating that the door 1 is closed is supplied to a port R5 of a CPU as well as when the switch 18 is opened, a signal "0" indicating that the door 1 is not closed is supplied to a port R4.

While the engaging member 15E is being moved from the third position 15S to the second position 15R, the engaging member 15E is brought into engagement with the distal end portion 14 with resulting that the pawl 12 is rotated in the clockwise direction. Thus, the pawl 12 is removed or disengaged from the latching member 10. After the disengagement of the pawl 12 from the latching member 10, a lower end portion of the shaft 15 which is in the downward movement is brought into engagement with a switch 19. Then, the switch 19 is turned on or closed in a signal "0" indicating that the door 1 is opened to a port R6 of the CPU 32.

In FIG. 2c, when the outside door handle 25 having a lever 24, is moved upwardly for opening the door 1, the lever 24 is rotated in the clockwise direction and moves a lever 23 in the downward direction. Then, a switch 23 is closed and a signal "0" indicating that the door 1 is opened to a port R3 of the CPU 32.

In FIG. 2d, when a key 30 is inserted into a rotor 29b of the door key cylinder 29a and is rotated rotated in the counter clockwise direction, a lever 28 is also rotated in the counter clockwise direction with resulting that a switch 26 is brought into closure. Thus, a signal "0" indicating that the door 1 is in unlocked condition is supplied to a port R2 of the CPU 32.

Figure 2E:
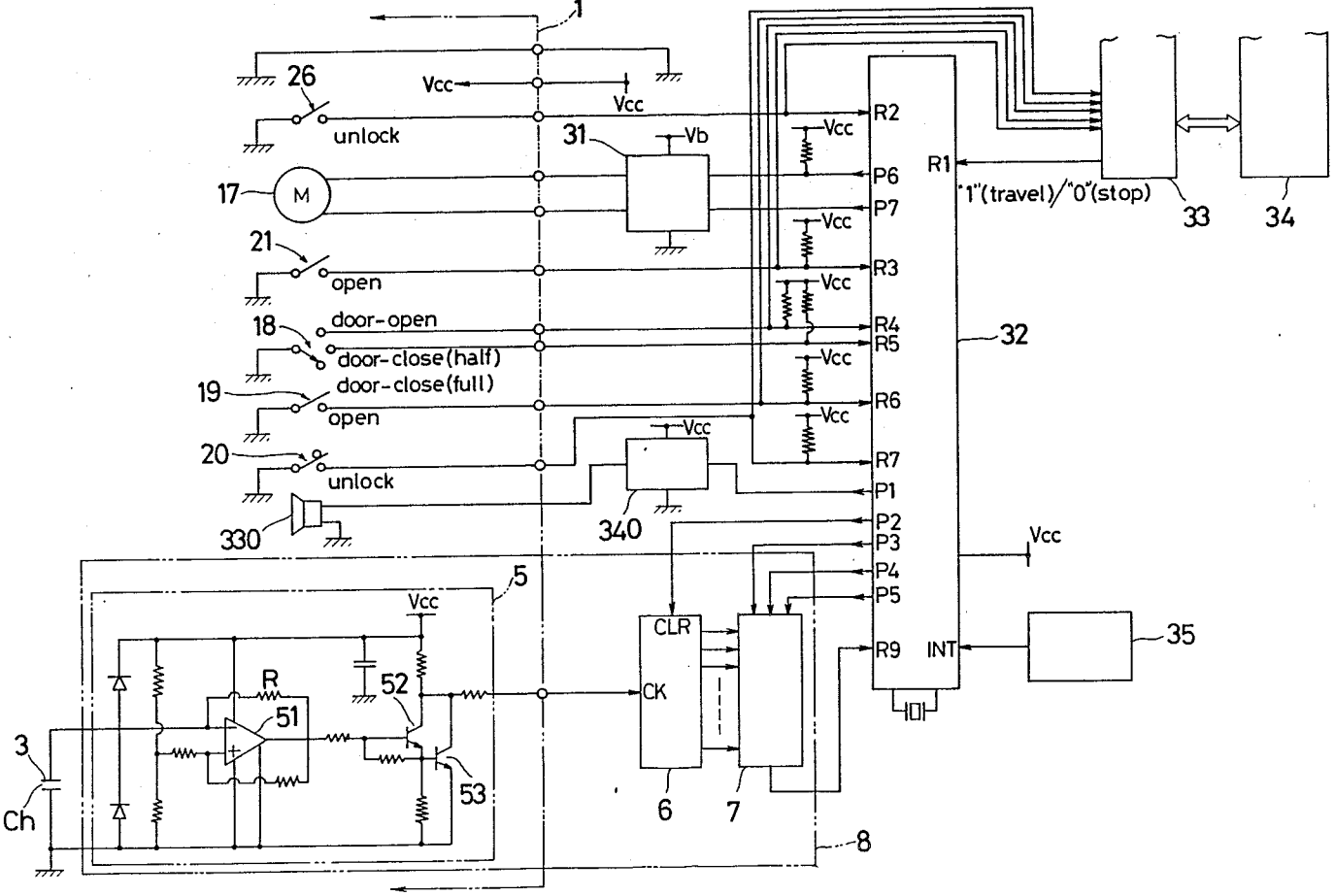

In FIG. 2e, there is shown a block diagram of a control device 100 to which afore-mentioned electrical components are connected. The pulse generator 5 is constituted by connecting Darlington circuit, including therein transistors 52 and 53 as chief components, to an output terminal of a non-stable mono-multi vibrator including therein an operational amplifier 51 as a chief component. Frequency of oscillation from the non-stable mono-multi vibrator is determined by the value of the capacitance Ch of the condenser defined between the thin metal 3 and the door 1 which is grounded. An output signal is generated from the generator 5 in the form of rectangular pulse and is previously amplified at the transistors 52 and 53 before being applied to a port CK of a counter 6. In the counter 6, numbers of pulse signal applied thereto are counted and resulting data is fed to a P/S (parallel input/serial output) shift register 7. The reset or the clear of the counter 6 and read from/write to the register 7 are performed by the CPU 32.

The motor 17 in the opening/closing device 9 is under the control of the CPU 32 via a motor-driver 31. The buzzer 330 provided inside of the door 1 is electrically connected to the the CPU 32 via a buzzer-driver 340. The CPU 32 has an interruption terminal INT to which a pulse signal having cycle of 0.1 sec is applied from a pulse generator 35. The CPU 32 is also electrically connected to a master processor 34 via an interface 33. The master processor 34 is used for indicating vehicle-velocity, the opening/closing condition of the door 1 and the other informations to the motorist through instruments (not shown) provided at a dash-board in a vehicle. It is noted that the electric components encircled by two-dotted line are provided or located in the door 1; and the other or remained components are provided in the dash-board.

Hereinafter the operations of the CPU 32 are described with reference to FIGS. 3a through 3d. First of all, voltage Vcc is applied to the CPU 32 (step 1), initialization is performed. In detail, inner counters, registers, flags and timers are reset (step 2). Under this condition, the CPU 32 executes a timer interruption routine 40 shown in FIG. 3d at each time one pulse signal is applied to the port INT. Due to the execution of timer interruption routine 40, it is checked whether holding portion 2b of the grip 2 is gripped or not. In detail, in response to one shot pulse applied to the port INT from the generator 35, the CPU 32 begins to execute the timer interruption routine 40. First, contents in a register R1*a* are read into a register R1*b* (step 41). Then, data in the counter 6 is written in the shift register 7 and thereafter the counter 6 is reset (step 42). Next, data in the shift register 7 is read in serial manner (step 43) and is written into the register R1*a* (step 44). Since such interruptional executions are performed each time one pulse signal is generated from the generator 35, when the data is loaded in the register R1*a*, value therein denotes pulse rate of one cycle before, and value in the register R1*b* denotes pulse rate of two cycle before.

The CPU 32, at this time, checks whether the holding portion 2b is gripped or not (step 45). If the holding portion 2*b* has not been held, data in the register S1 is "0". In this case, data obtained by subtracting data in the register R1*a* from data in the register R1*b* is written into a register R1*c* (step 46) and data in the register R1*a* is written into a register Ref1 for the renewal of the reference. Then, whatever data in the register R1*a* is greater than the set value C1 (step 48). If so, the holding portion 2*b* is regarded to be held. Since at this time the data in the register R1*a* is equal to that in the register Ref1 (step 49), data "1" indicating the grip is loaded in a detecting register M1 (step 50) and a flag register S1 (step 50). Thereafter, the CPU 32 executes main routine. Upon next execution of the timer interruption routine 40, steps 41,42,43,44,45 and 49 are performed without updating data in the register Ref1. In step 49, data in the register Ref1 is compared to data in the register R1*a* which is newly read data. If the latter is greater than the former, this means that the holding portion 2*b* has been gripped. In this case, the CPU 32 returns to main routine after execution of the steps 50 and 51. If the latter is less than the former, this means that the holding portion 2*b* is not gripped. Thus, data "0" is loaded into the register M1 and the flag register S1. Thereafter, the CPU 32 returns to main routine.

In accordance with the execution of the timer interruption routine 40, data in the register M1 indicating whether the holding portion 2*b* is gripped or not is generated as follows.

(1) Assume that the holding portion 2*b* is not gripped.

Each time the timer interruption routine 40 is executed, steps 42 through 48 and return are performed, so that data in the register R1*a* and data in the register Ref1, only, are updated. Data in the detecting register M1 is "o" which indicates that the holding portion 2*b* is not gripped.

(2) Assume that the holding portion 2*b* is gripped before the first execution of the timer interruption routine 40.

Data "1" indicating that the holding portion 2*b* is gripped is written into the detecting register M1 and the flag register S1 while the steps 41 through 51 and return are performed.

(3) Assume that the holding portion 2*b* is being gripped.

Steps 41,42,43,44,45,49,50,51 and return are performed so that data in the register R1*a* is updated.

(4) Assume that the hand is removed from the holding portion 2*b*.

Since data in the register R1*a* is greater than data in the register Ref1, steps 41,42,43,44,45,49,52,53 and return are performed so that data in the detecting register M1 and data in the flag register S1 are updated to "0".

Due to the repetitional execution of the timer interruption routine 40, data "1" or data "0" is stored in the detecting register M1 for indicating whether the holding portion 2*b* is gripped or not.

Figure 3A:
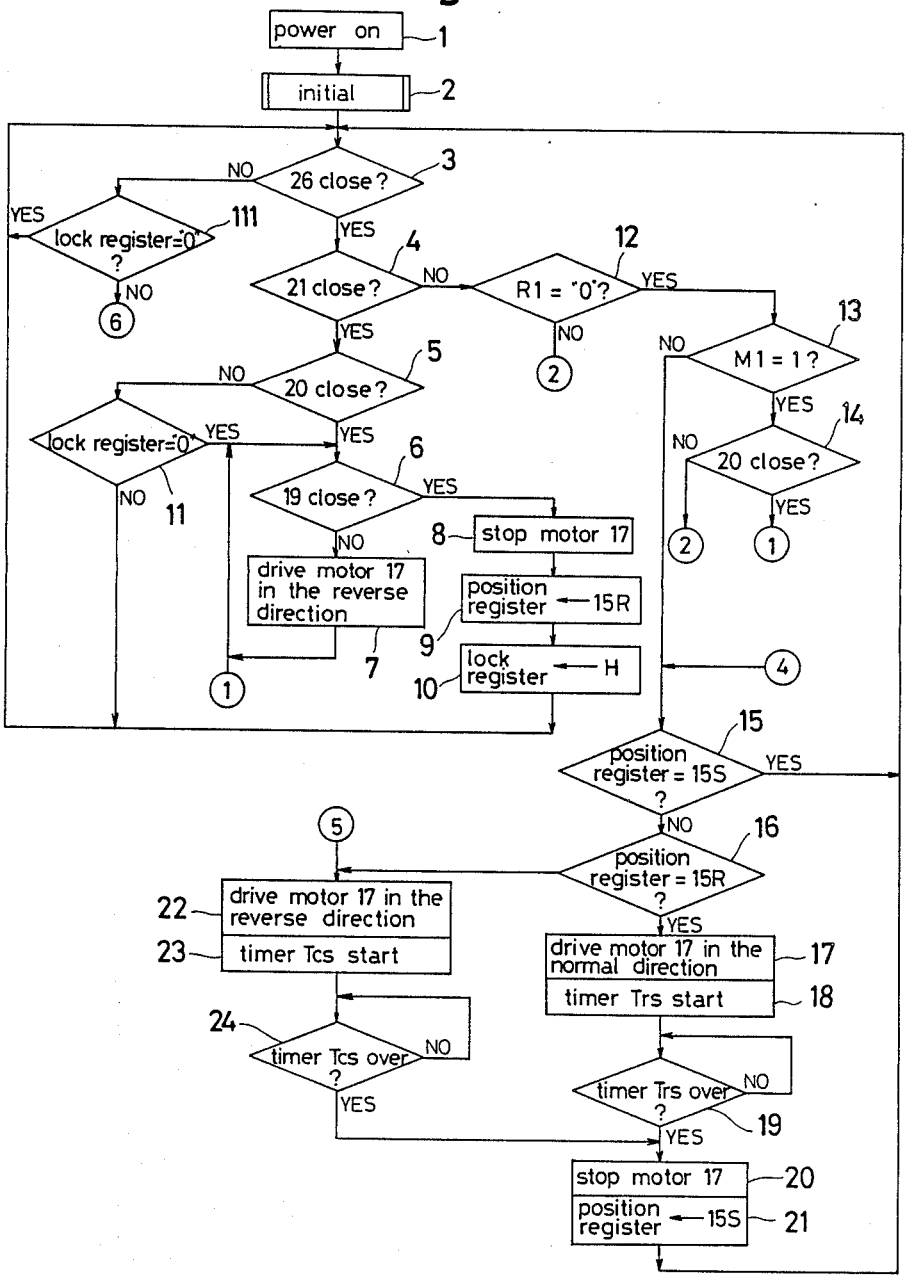
* and FIGS. 3*a*, 3*b*, 3*c* and 3*d* show flow charts indicating operations of a microprocessor incorporated in the device in FIG. 2*e*.
Figure 3B:
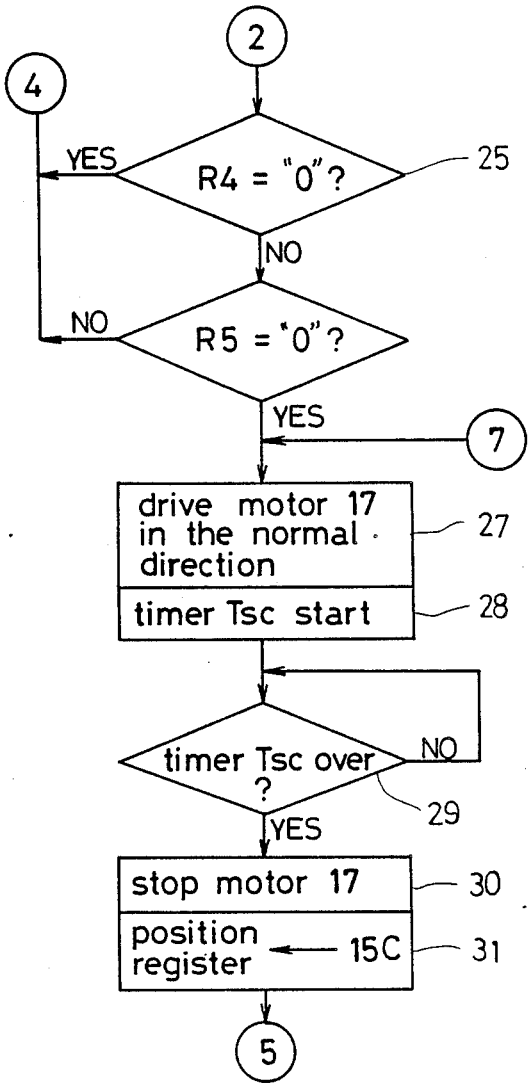
Figure 3C:
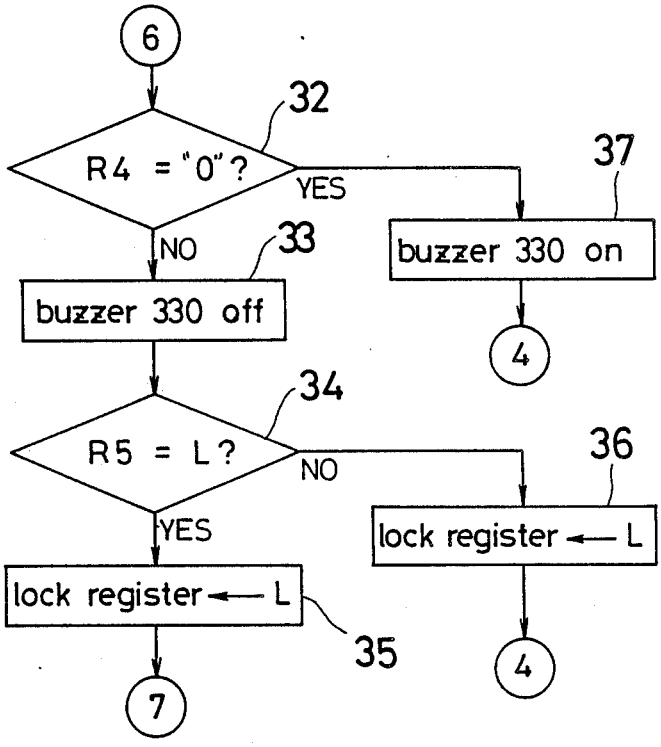
Figure 3D:
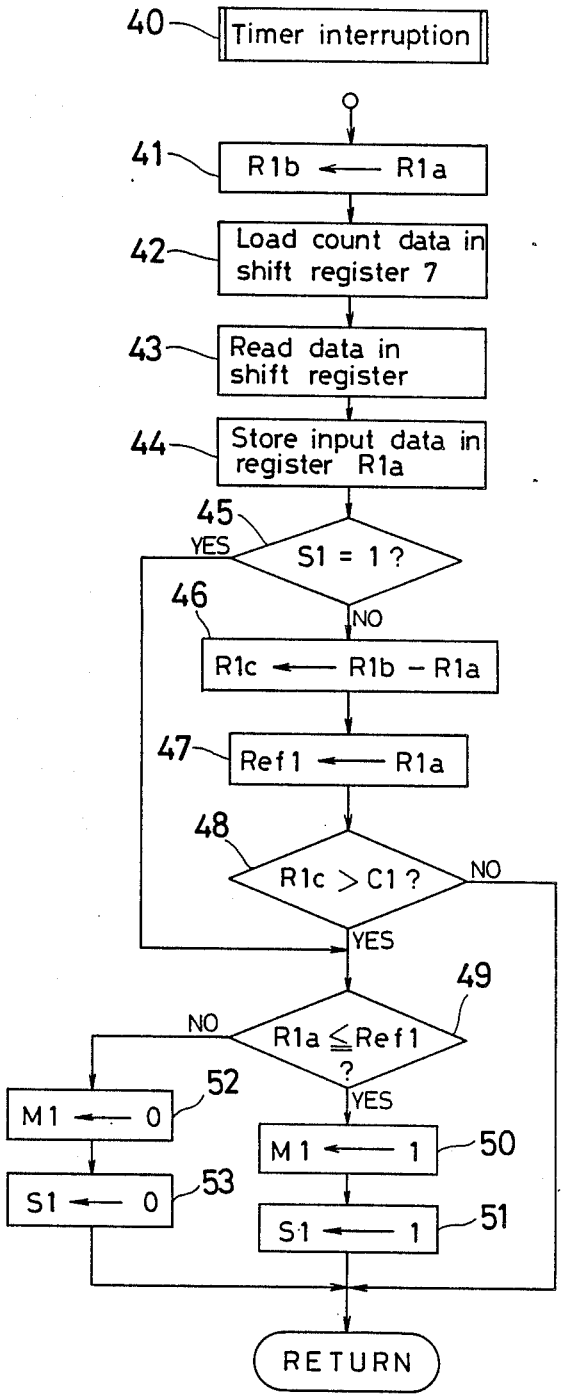

The main routine shown in FIGS. 3*a* through 3*c* controls the movement of the shaft 15 as follows in accordance with the conditions of the switches 18,19,20,21 and 26 and data in the detecting register M1.

(1) Assume that the door 1 is opened from the outside before the motorist is going to get into the vehicle.

At this time, the engaging member 15E is positioned at its third position 15S and the latching member 10 is positioned its first position as shown in FIG. 1*b*.

The motorist turns the key 30 in the counter clockwise direction after insertion thereof into the rotor **29*b* and pulls the door 1 towards himself with moving the outside door handle 25 upwardly. Due to the counter-clockwise rotation of the rotor 29*b* and the upward movement of the handle 25, both of the switches 26 and 21** are closed. Thus, data "0" is fed to the ports R2 and R3.

The CPU 32 checks the condition of the lock switch 20 after performing the steps 3 and 4. When the switch 20 is closed, the CPU 32 performs the step 6 for checking the condition of the switch 19. Since the switch 19 is opened, the CPU 32 feeds signal to the motor-driver 31 for driving the motor 17 in the reverse direction (step 7) and continues the monitoring of the switch 19 (step 6). When the switch 19 is brought into closure, the CPU 32 stops the motor 17 (step 8) and loads data indicating that the engaging member 15E is in its second position 15R into a position register (step 10). Thereafter, the CPU 32 performs the steps 3,4,5,6,8,9,10 and 3 in a loop or endless manner. Under this condition, since the pawl 12 is away from the latching member 10, the latching member 10, which is rotatably in the counter clockwise direction, may be removed from the striker 11. Thus, the door 1 is opened.

Upon the removal of the hand of the motorist from the outside handle 25, the switch 21 is returned to its opened condition. Then, the CPU 32 performs the steps 3,4 and 12. In the step 12, the CPU 32 checks the signal fed to the port R1 from the master processor 34. If the vehicle is in motion (stop), the signal denotes "1" ("o"). In this case, the signal is "0" so that the CPU 32 performs the step 13. Since the holding portion 2*b* is not gripped, data in the register M1 is "0". Thus, the CPU 32 checks data in the position register by performing the steps 15 and 16. Since data in the position register indicates that the engaging member 15E is at its second position 15R, The CPU 32 drives the motor 17 in the normal direction (step 17), starts the program timer Trs (step 18) and waits the time elapsed (step 19). It is noted that the time to be elapsed is a time required for the engaging member 15E to move from the second position 15R to third position 15S. When the time is over, the motor 17 is stopped (step 20) and data indicating that the member 15E is in its third position is stored in the position register.

After the motorist gets into the vehicle and sits in the seats, he pulled the door 1 towards himself for closing the door 1. Then, the latching member 10 is transferred to the first condition (FIG. 1*b*) or the second condition (FIG. 1*d*) from the third condition (FIG. 1*c*).

(2) Assume that the out door handle 25 is operated even though the motorist is in the vehicle and the lock switch 20 is opened for locking the door 1.

In this case, since the CPU 32 performs the steps 3,4,5,11 and 3 endlessly the door 1 may not be brought into the unblocked condition.

(3) Assume that the motorist intends to open the door 1 from inside of the vehicle during the stopping thereof in spite of the locked condition of the door 1.

In this case, since the holding portion 2*b* is gripped, data in the detecting register M1 is set into "1". After performing the the steps 3,4,12,13 and 14, the CPU 32 performs the steps 25 and 26 since the locking switch is opened due to the locked condition of the door 1. If the door 1 is in the full-latched condition or the half-latched condition, the CPU 32 performs the steps 15 and 3 without performing the steps 6 through 10 for the unlocking operation.

(4) Assume that the motorist intends to open the door 1 from inside of the vehicle during the stopping thereof after closure of the locking switch 20.

In this case, since the holding portion 2*b* is gripped, data in the detecting register M1 is set to "1" due to the execution of the timer interruption routine. The CPU 32 performs the steps 3,4,12,13 amd 14. Since the locking switch 20 is closed, the CPU 32 performs the step 6 and 7 so long as the door 1 is opened. If the door 1 is opened during the performing the steps 6 and 7, the CPU 32 begins to perform the steps 7 through 10, thereby moving the engaging member 15E to its second position 15R from its third position 15S. Thus, the pawl 12 is removed from the locking member, thereby releasing the locked condition of the door 1. While the holding portion 2*b* is being gripped, the motorist may open the door 1 at will.

When the hand is removed from the holding portion 2*b*, due to the performing the steps 3,4,12,13,15,16,17,18,19,20 and 21, the engaging member 15E is returned to its third position 15S from its second position 15R.

(5) Assume that the locking switch 20 is opened for bringing the door 1 into the locked condition when the door is in the half-latched condition, or that the door 1 is brought into the half-latched condition after the opening the locking switch.

The CPU 32 performs the steps 27 through 31 for bringing the door 1 into its full-latched condition after performinng the steps 3,4,12,13,14,25 and 26. In detail, the CPU 32 drives the motor 17 in the normal direction (step 27), starts a program timer Tsc (step 28) and waits the elapsed time (step 29). It is noted that the elapsed time is the time required for moving the engaging member 15E from its second position 15R to its first position 15C. After the time elapsed, the latching member 10 is rotated in the counter-clockwise direction due to the upward movement of the engaging member 15E in FIG. 1*a* and is transferred to its first position as shown in FIG. 1*b*. Simultaneously, the motor 17 is stopped (step 30) and data indicating that the engaging member 15E is at its first position is loaded into the position register. Upon completion of this operation for bringing the door 1 into its the full-latched condition, the CPU 32 performs the steps 22,23,24,20 and 21 (FIG. 3*a*) so as to return the engaging member 15E to its third position 15S and loads data indicating that the engaging member 15E is at its third position 15G into the position register.

(6) Assume that the vehicle begins to start.

In this case, the signal from the master processor 34 to the port R4 is changed from "0" into "1". Then, the CPU 32 performs the steps 3, 4, 12 and 24 (FIG. 3*b*). The CPU 32 checks whether the door 1 is opened or in the half-condition in the steps 25 and 26. If the door 1 is opened, the engaging member 15E is transferred to its third position 15S. Thus, the latching member 10 may be brought into engagement with the striker 11 when the motorist pulls the door 1 towards himself. If the door 1 is in the half-latched condition, the steps 27 through 31, 22,23,24,20 and 20 are performed. Thus, the door 1 is brought into the full-latched condition and the engaging member 15E is retuned to its third position 15S. Thereafter, during the vhicle traveling, the steps 3,4,12,25,26,15 and 3 are performed in looped manner so as to prevent the downward movement of the engaging member 15E, thereby assuring the engagement between the latching member 10 and the pawl 12.

(7) Assume that the door 1 is locked by inserting the key 30 into the key cylinder 29*a* after the motorist got out of the vehicle.

Due to the clockwise rotation of the key 30 inserted in the rotor 29*b* in the cylinder 29*a*, the switch 26 is opened, thereby changing the signal fed to the port R2 into "0", Then, the CPU 32 performs the step 111 after performing the step 3 for checking data in the lock register. If data at issue is "1", it is regarded that the door 1 is not brought into the locked condition corresponding to the key 30 operation. In such case, the CPU 32 checks whether the door 1 is opened or not (step 32). If the door 1 is opened, the buzzer 330 is brought into operation for alarming (step 37). This alarm operation is continued until the door 1 is brought into the half-latched or the full-latched conditions during the loop performing of the steps 15, 3, 111, 32, 37 and 15. If the door 1 is brought into the half-latched condition (step 34), data "0" is loaded in the lock register (step 35). Thereafter, the CPU 32 brings the door 1 into its full-latched condition, moves the engaging member 15E to its third position 15S and returns to the step 3. If the door 1 is in its full-latched condition, the CPU 32 returns the step 3 after performing the steps 36 and 15.

When the CPU 32 returns to the step 3, the door 1 is in its fully-latched condition, the the engaging member 15E is in its third position 15S and the projection 12*b* of pawl 12 is in engagement with the projection 10*c* of the latching member 10. Under this arrangement, the CPU 32 performs the loop operation of the steps 3,111 and 3.

What is claimed is:

1. A device for latching and unlatching a door, comprising:

a striker;

a latching member rotatably mounted to the door, the latching member being rotatable to a first latch position in engagement with the striker and rotatable to a second latch position out of engagement with the striker;

a pawl rotatably mounted to the door, the pawl being rotatable between a regulatory position for holding the latching member in the first latch position and a releasing position for permitting movement of the latching member to the second latch position;

urging means for biasing the pawl to the regulatory position;

operating means operative when driven to a first operating position to rotate the latching means to the first latch position and operative when driven to a second operating position to rotate the latching means to the second latch position;

first detecting means for detecting the closing of the door;

second detecting means for detecting circumstances preparatory to opening of the door; and controlling means responsive to the detection of the closing of the door by the first detecting means for driving the operating means to the first operating position, and responsive to the detection of circumstances preparatory to opening the door by the second detecting means for driving the operating means to the second operating position.

2. A door opening/closing device according to claim 1 wherein said urging means is a spring.

3. A door opening/closing device according to claim 1 wherein said controlling means is under the control of a micro-processor.

4. The device of claim 1 wherein the operating means includes a member driven in one direction to the first operating position into engagement with the latching member, and driven in the opposite direction to the second operating position into engagement with the pawl, and includes a motor for driving the operating member in opposite directions to the first and second operating positions.

5. The device of claim 1 wherein the second detecting means includes means for detecting the grasping of the door handle.

6. The device of claim 1 further comprising:

third detecting means for detecting an unsafe condition for opening the door, and wherein the controlling means is ineffective to drive the operating means to the second operating position in response to the detection by the second detecting means at times when the third detecting means detects the unsafe condition.

* * * * *